US005460561A

United States Patent [19]

Dahlgren

[11] Patent Number: 5,460,561

[45] Date of Patent: Oct. 24, 1995

[54] TOY KIT OF STACKABLE GEOMETRIC SHAPE PIECES TO FORM A STRUCTURE

[75] Inventor: Britt Dahlgren, Askim, Sweden

[73] Assignee: Lennart Dahlgren, Sweden

[21] Appl. No.: 168,534

[22] Filed: Dec. 16, 1993

[51] Int. Cl.[6] ..... A63H 33/00

[52] U.S. Cl. ..... 446/117; 446/70; 446/103; 446/166

[58] Field of Search ..... 446/70, 85, 89, 446/103, 117, 124, 166

[56] References Cited

U.S. PATENT DOCUMENTS

| | | | |
|---|---|---|---|
| 499,512 | 6/1893 | Brower | 446/85 |
| 1,201,579 | 10/1916 | Hall | 446/166 |
| 3,091,361 | 5/1963 | Gawron | 446/117 |
| 3,691,672 | 9/1972 | Pendill | 446/70 |
| 4,346,885 | 8/1982 | Mathou | 446/70 |

FOREIGN PATENT DOCUMENTS

| | | | |
|---|---|---|---|
| 187027 | 10/1956 | Austria | 446/117 |
| 660422 | 7/1929 | France | 446/117 |
| 1192980 | 10/1959 | France | 446/70 |
| 1402024 | 5/1965 | France | 446/70 |
| 1523814 | 9/1978 | United Kingdom | 446/117 |
| 2144647 | 3/1985 | United Kingdom | 446/124 |

OTHER PUBLICATIONS

"Magic Castle Molds", Playthings, Feb. 1981.

"Toboga", Childcraft Catlog.

*Primary Examiner*—Robert A. Hafer
*Assistant Examiner*—Jeffrey D. Carlson
*Attorney, Agent, or Firm*—Ostrolenk, Faber, Gerb & Soffen

[57] ABSTRACT

A toy kit for forming a structure. Individual pieces include at least a cylinder, cone, cube and prism, and at least one additional piece. The piece can be assembled to form a structure, e.g. a sand castle. The pieces are hollow and open bottomed and include fixtures enabling mutual assembly together. Holes in their top walls permit passage of water or sand.

14 Claims, 10 Drawing Sheets

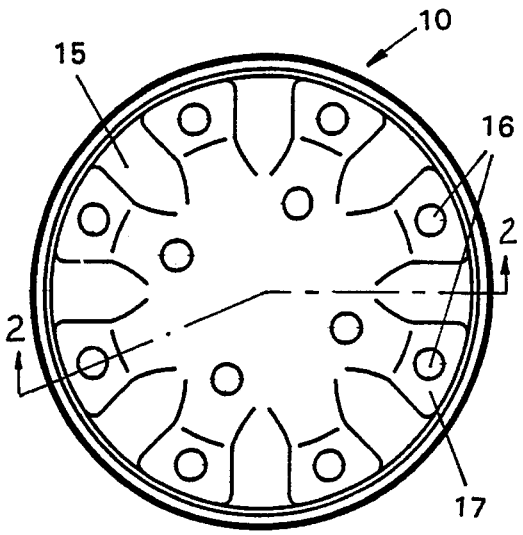
FIG. 1
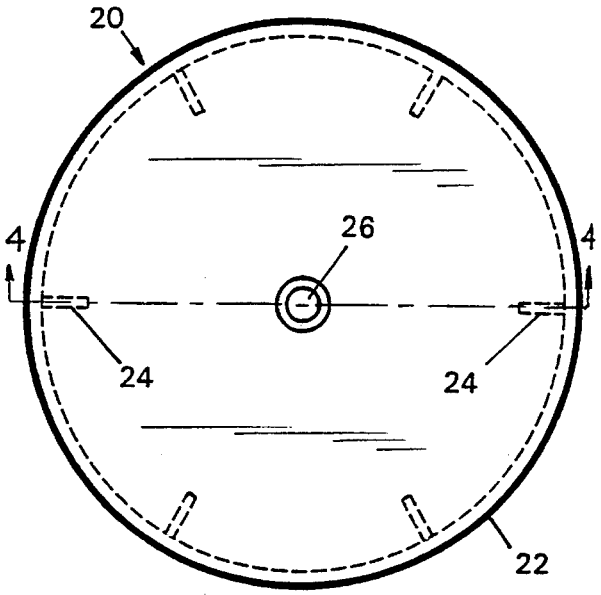
FIG. 3
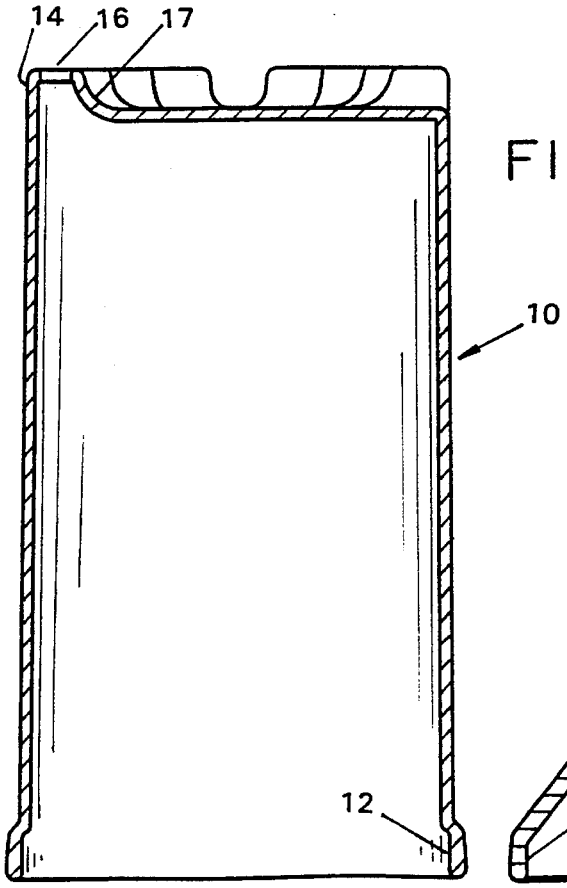
FIG. 2
FIG. 4
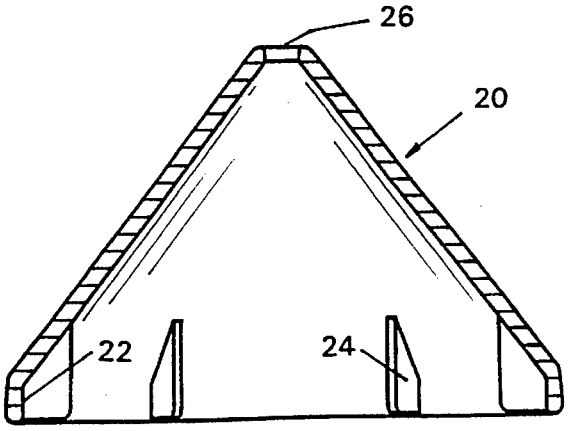

FIG. 7
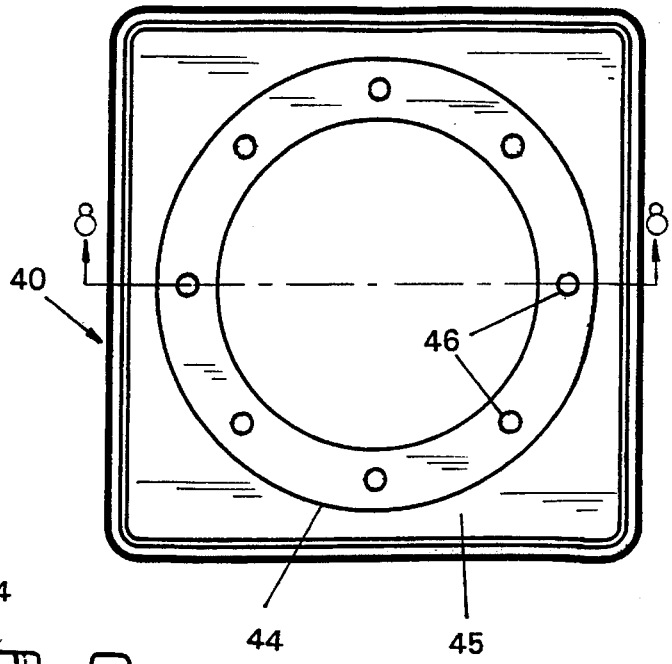
FIG. 5
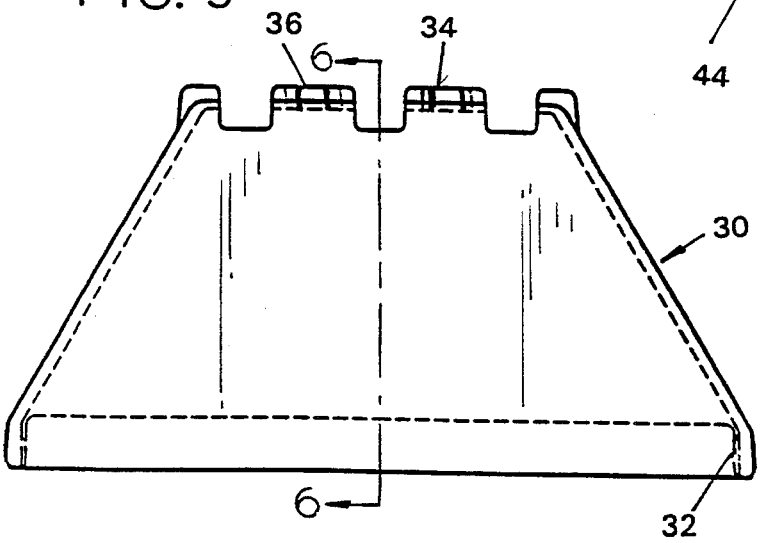
FIG. 8
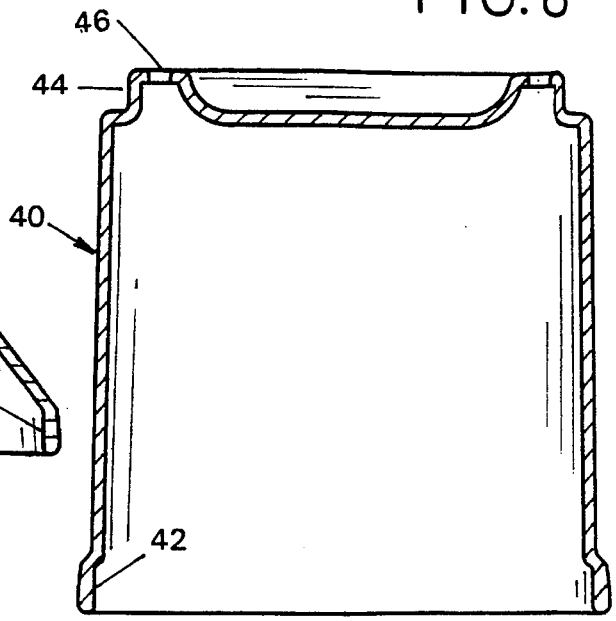
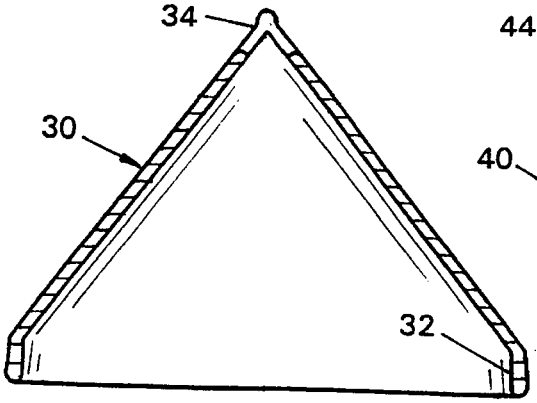
FIG. 6

FIG.14
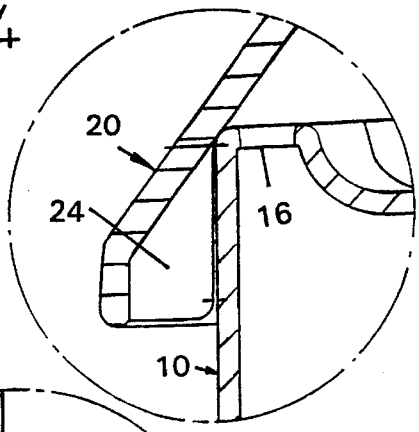
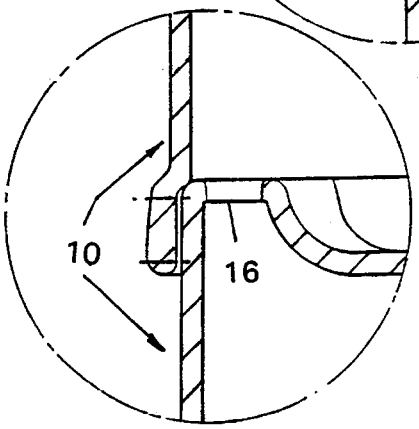
FIG.15
FIG.16
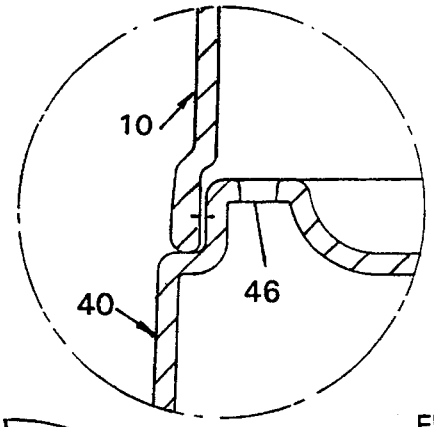
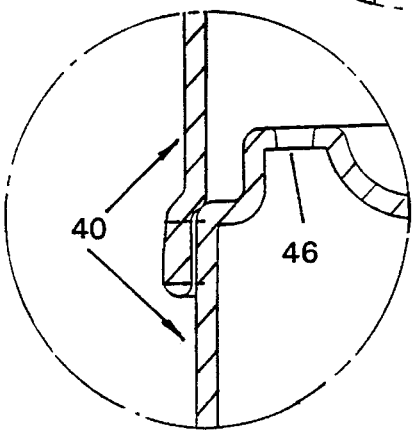
FIG.17
FIG.13
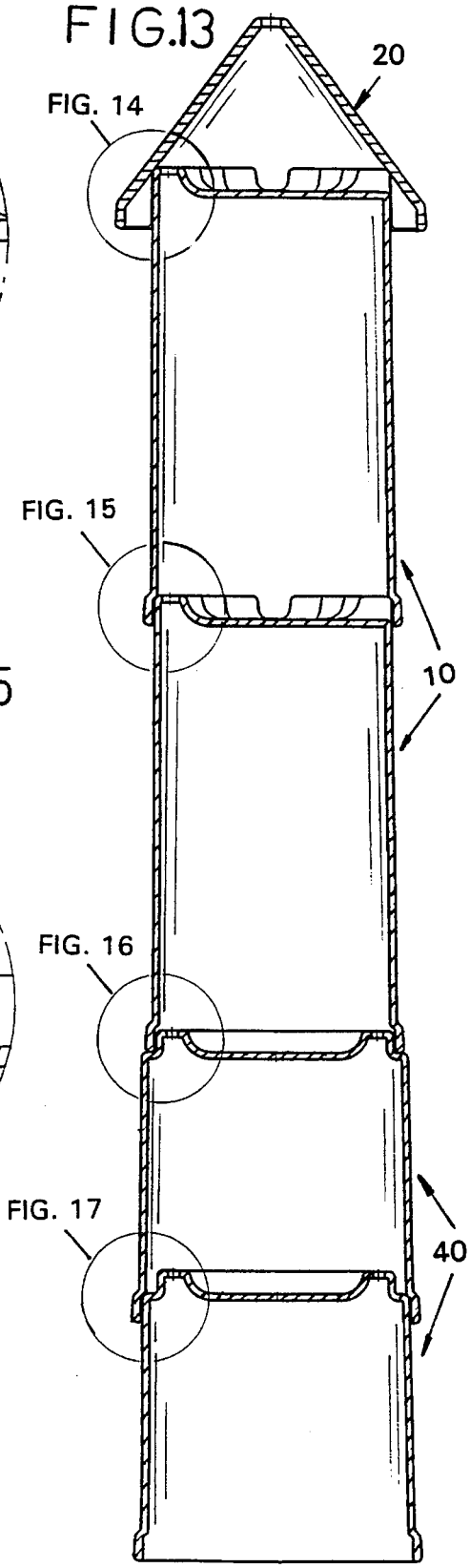

30
57
34
30

30
40
50

TOY KIT OF STACKABLE GEOMETRIC SHAPE PIECES TO FORM A STRUCTURE

BACKGROUND OF THE INVENTION

The present invention relates to a toy kit that includes individual pieces which are assemblable to form a structure.

Toy kits comprised of a number of building blocks are known, for example, toy kits having building blocks that can be stacked and/or snapped or locked together. However, known multi-piece toy kits do not include various individual pieces that are of various geometric shapes, are assemblable to form interesting or complicated structures, such as castles, and also which may serve as containers for material, like sand, or dispensers of fluent material, like sand or water. Also, the individual components in known toy kits are not shaped to make sand or water castles in true castle component shapes.

SUMMARY OF THE INVENTION

Accordingly, there is a need for a toy kit having individual pieces of various geometric shapes, which along with additional components, can be assembled into interesting or complicated structures such as castles.

Among the objects of the present invention is to provide a toy kit including individual building pieces that are assemblable into the desired structure.

Another object of the invention is to provide a toy kit with individual pieces that can be used as molds for building structures such as sand castles.

A still further object of the invention is to provide a toy kit with pieces that are like building blocks and that are assemblable to form a water castle.

These and other objects of the invention are attained by providing a toy kit for forming a structure, comprising individual pieces including at least one cylinder, cone, cube and prism, and at least one additional block or piece, the blocks and the piece being assemblable in various arrangements to form a structure. The geometric shape pieces may each be hollow with an open bottom so that sand, water or the like may be placed in it and it may be used as a sand mold. The closed top end may have outlet holes for pouring out or dripping of material inside the piece. The bottom and top may include fixtures, like collars, ridges or grooves, which enable engagement of the pieces to each other.

Other features and advantages of the present invention will become apparent from the following description of the invention which refers to the accompanying drawings.

BRIEF DESCRIPTION OF THE DRAWINGS

FIG. 1 is a bottom view into the open bottom end of a cylinder piece of a kit according to the invention;

FIG. 2 is a cross-sectional view along the path of bent line 2—2 of FIG. 1;

FIG. 3 is a top view of a cone piece of a kit according to the invention;

FIG. 4 is an elevational cross-sectional view along line 4—4 of FIG. 3;

FIG. 5 is a side view of a prism piece of a kit according to the invention;

FIG. 6 is an elevational cross-sectional view along line 6—6 of FIG. 5;

FIG. 7 is a bottom view into the open bottom end of a cube piece of a kit according to the invention;

FIG. 8 is an elevational cross-sectional view along line 8—8 of FIG. 7;

FIG. 13 shows an example of an assembly of pieces of the kit of the invention;

FIGS. 14–17 show enlarged views of the connections between the assembled pieces shown in FIG. 13;

DETAILED DESCRIPTION OF THE INVENTION

Figure 9:
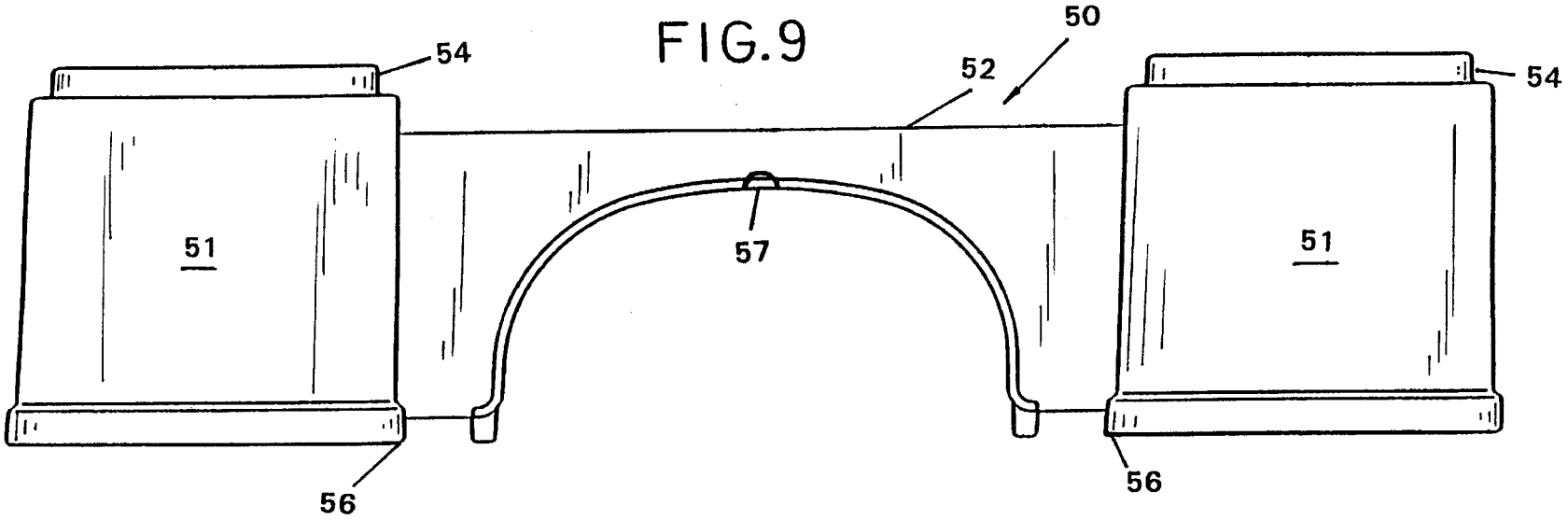
FIG. 9 is a side view of a bridge piece of a kit according to the invention.

The individual geometric shape pieces of the kit of the invention include a cylinder, cone, cube and prism, which are described in detail below. Those pieces preferably have a hollow structure and are open at one end, i.e. at their bottom. Means are provided on the top and bottom of each piece for assembling it to neighboring pieces.

FIGS. 1 and 2 show a hollow individual cylinder piece 10 for the kit according to the invention including an annular collar 12 formed around the bottom edge of the open bottom end of the cylinder piece 10 and an annular projection or rib 14 formed on the closed top end around the cylinder piece 10. The collar 12 corresponds in position and generally in its shape to a recess in or a peripheral body shape of others of the pieces and is adapted for receiving a projection or rib. The annular collar 12 and rib 14 are sized so as to cooperate with correspondingly shaped portions of other pieces to assemble the pieces into a taller structure, if desired. The projection 14 on one cylinder piece will be received and engaged on its outward surface by the collar 12 of another piece positioned above the one piece. The cylinder piece 10 is hollow and open bottomed, so that it might be filled with sand or water might be poured through it.

The closed top 15 of the cylinder piece 10 includes a circular array of spaced apart holes 16 near its periphery. The holes are formed in upraised bosses 17 on the closed top. The holes 16 would allow sand to pass either into or out of the cylinder piece 10, depending on how the piece 10 is oriented on other assembled pieces to build a sand castle. The holes 16 also permit passage of water or other fluent material. The bosses 17 define a projection which can be received in a collar 12.

FIGS. 3 and 4 show a hollow cone piece 20 for the kit according to the invention. An annular collar 22 is formed around the periphery of the open bottom of the cone piece 20. That collar 22 is the same size and shape as the collar 12 on the cylinder piece 10, enabling interlocking of a piece 20, 22 atop a piece 10, 14. Inwardly projecting, fin shaped projections 24 are provided at spaced intervals around the inside surface of the bottom rim of the cone piece 20 and the collar 22 for assembling the cone piece 20 atop some of the other pieces (FIGS. 13, 14, 18–21). Cones could be nested one inside the other and the fins inside one cone would rest on the outer surface of the cone beneath. An opening 26 is provided at the top of the cone piece 20 for the same purpose as the holes 16 in piece 10.

FIGS. 5 and 6 show a hollow prism piece 30 for the kit according to the invention. The prism is rectangular in a horizontal plane. There is a peripheral collar 32 formed around the open bottom of the prism piece 30 for the same purpose as the collars 12 and 22. A top, straight projection 34 of the prism is steepled. Holes 36 are provided at intervals along the projection 34. The holes 36 serve the purpose of the holes 16, 26. The projection 34 may be used for balancing a bridge piece 50 as described below.

FIGS. 7 and 8 show a hollow cube piece according to the invention. A peripheral collar or projection 42 is formed around the open bottom of the cube piece 40. An annular projection 44 is formed on the closed top or upper wall 45 of the cube piece 40. The projection 44 may have the shape and size of the projection 14 or a collar 12 on the cylinder piece 10 so that the cube piece 40 could be placed either below or above the cylinder piece 10, for instance. Holes 46 are provided through the top of the annular projection 44. The holes 46 may be used like the holes 16 in the cylinder piece 10.

Figure 10:
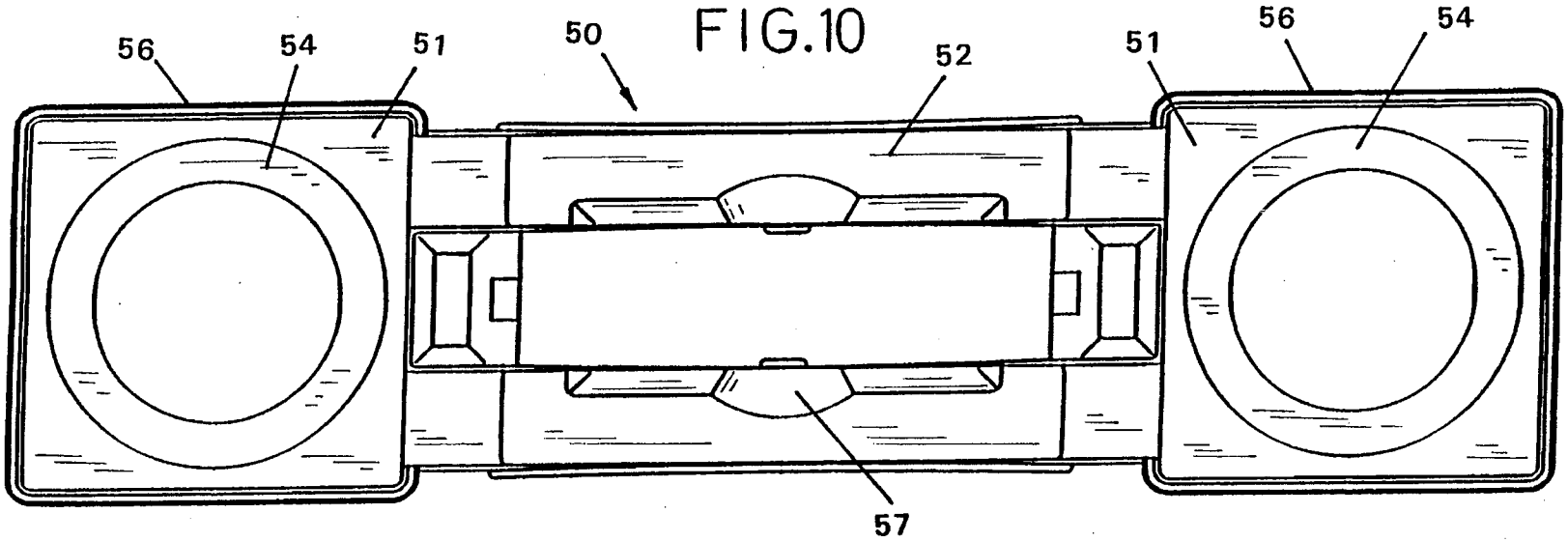
FIG. 10 is a bottom view into the open bottom end of the bridge piece of FIG. 9.
Figure 21:
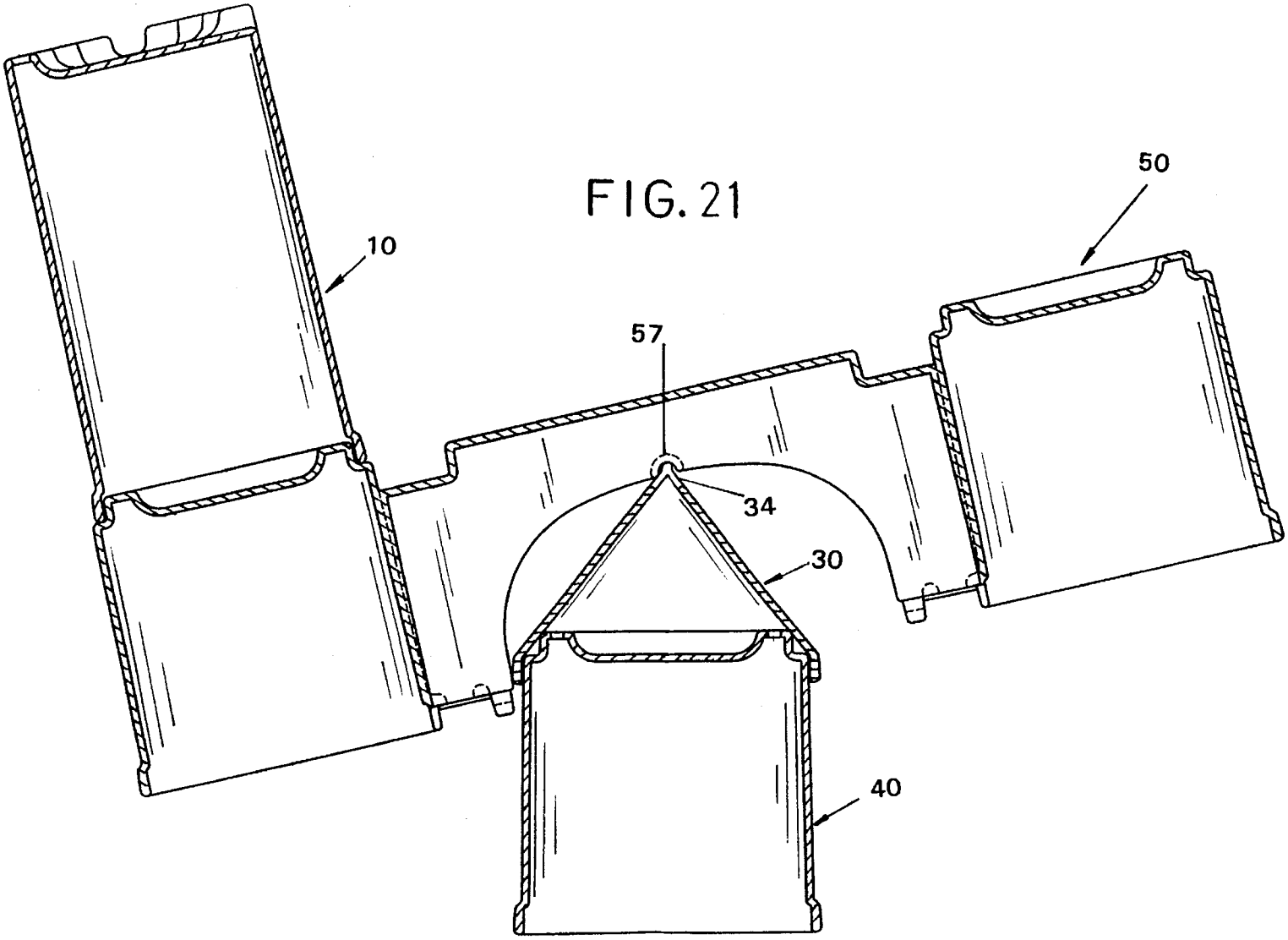
FIG. 21 shows another example of an assembly including a bridge piece.
Figures 23, 24:
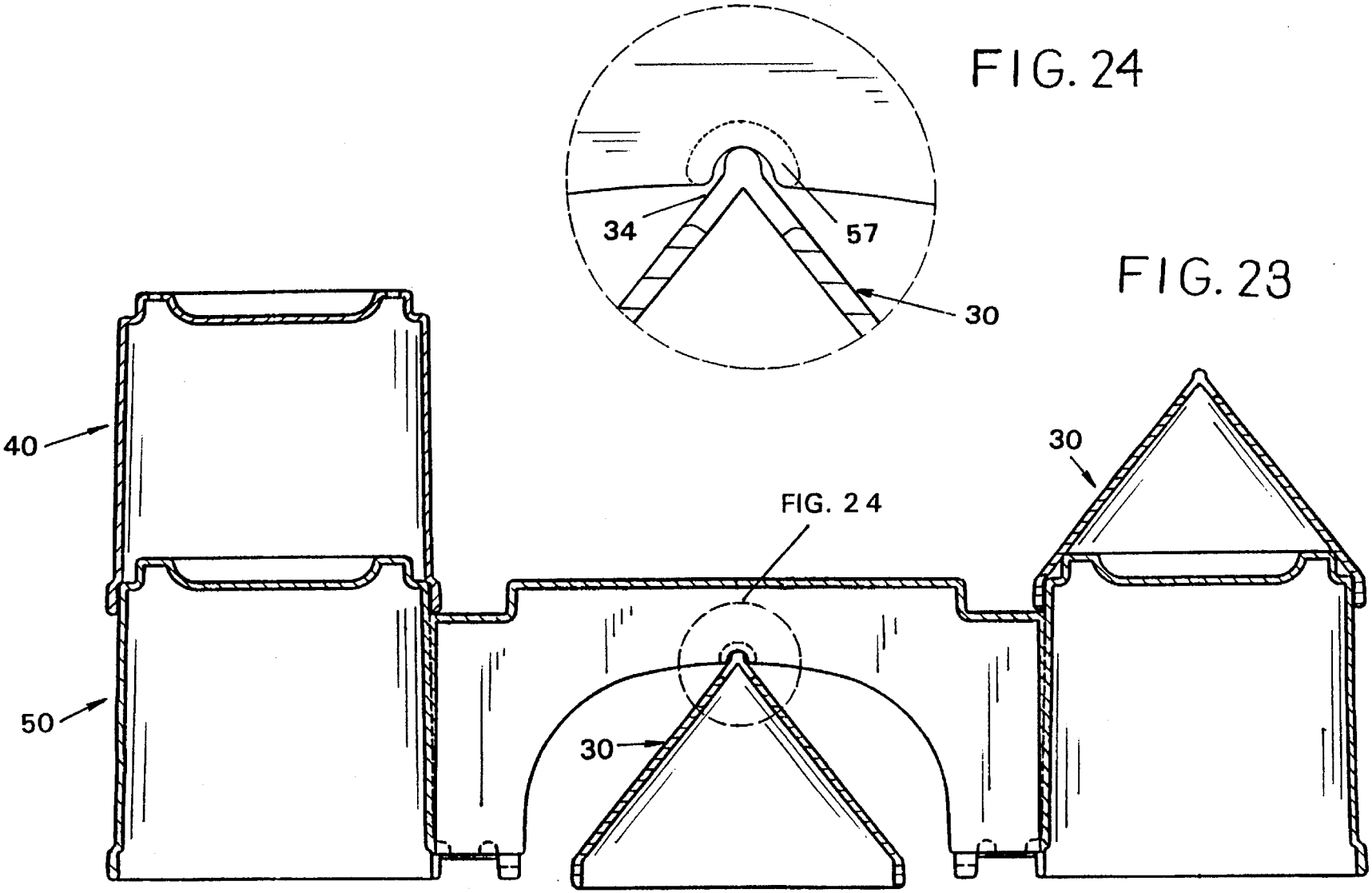
FIGS. 23 and 24 show, respectively, yet another example of an assembly including a bridge piece and an enlarged view of a connection between a prism piece and the bridge piece.

FIGS. 9 and 10 show a bridge piece 50 according to the invention including side pillars 51 of cube shape, like the cube shaped pieces 40. The pillars 51 have peripheral collars 56 formed around the open bottom ends of the end pillars 51 of the bridge piece 50. Annular projections 54 are formed on the closed tops of the end pillars 51 of the bridge piece 50. They correspond in size, shape and placement to the projection 14 on the cylinder piece 10. An arched middle or bridging portion 52 of the bridge piece 50 connects the two end pillars 51. An indentation 57 is provided in the middle portion 52 of the bridge piece 50. The indentation 57 is shaped for receiving the tapered top 34 of the prism piece 30 and may rock on the apex of the prism piece 30 (as shown in FIG. 21).

Figure 11:
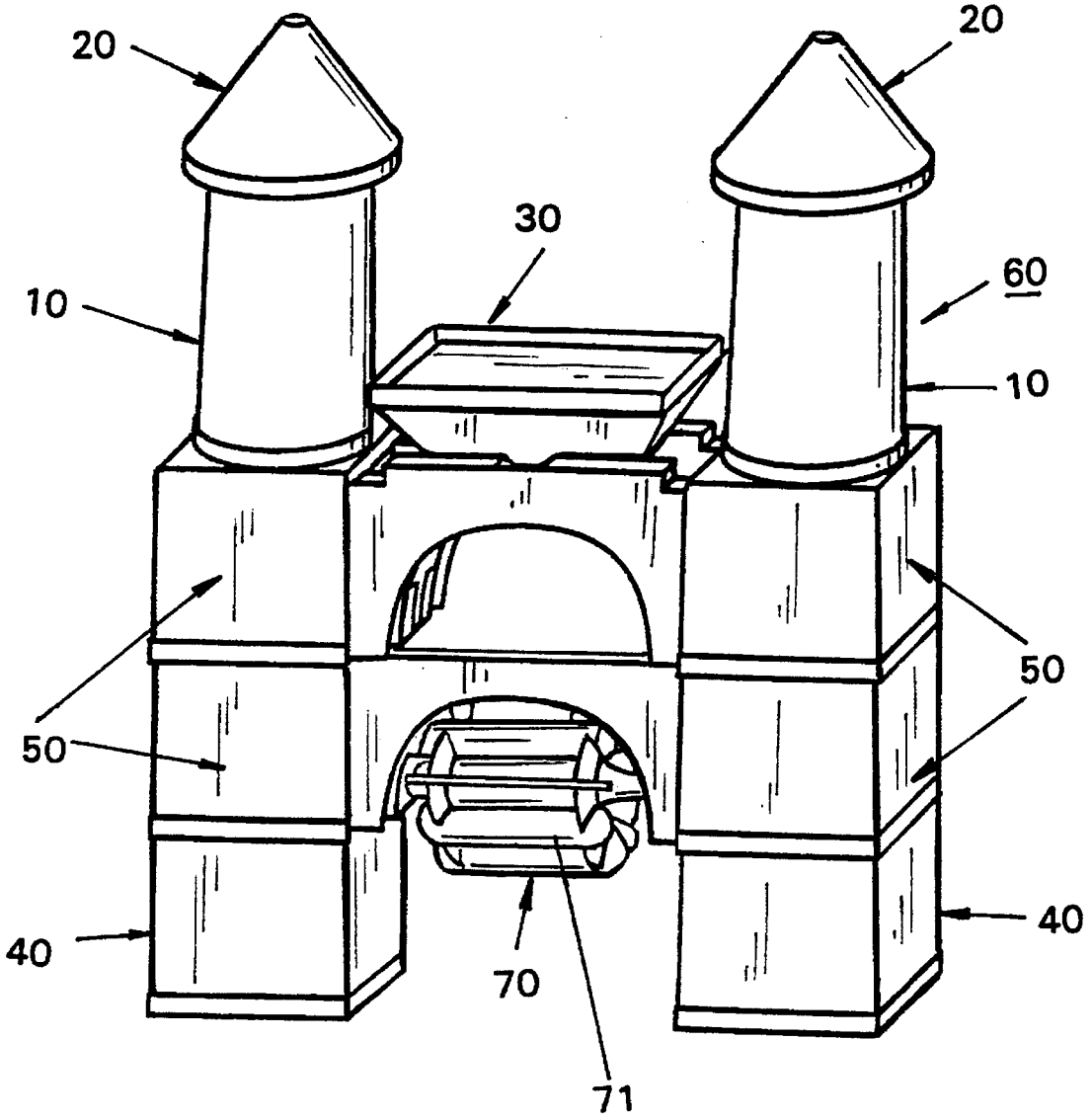
FIG. 11 shows an example of a structure formed by assembling pieces of the kit of the invention.
Figure 12:
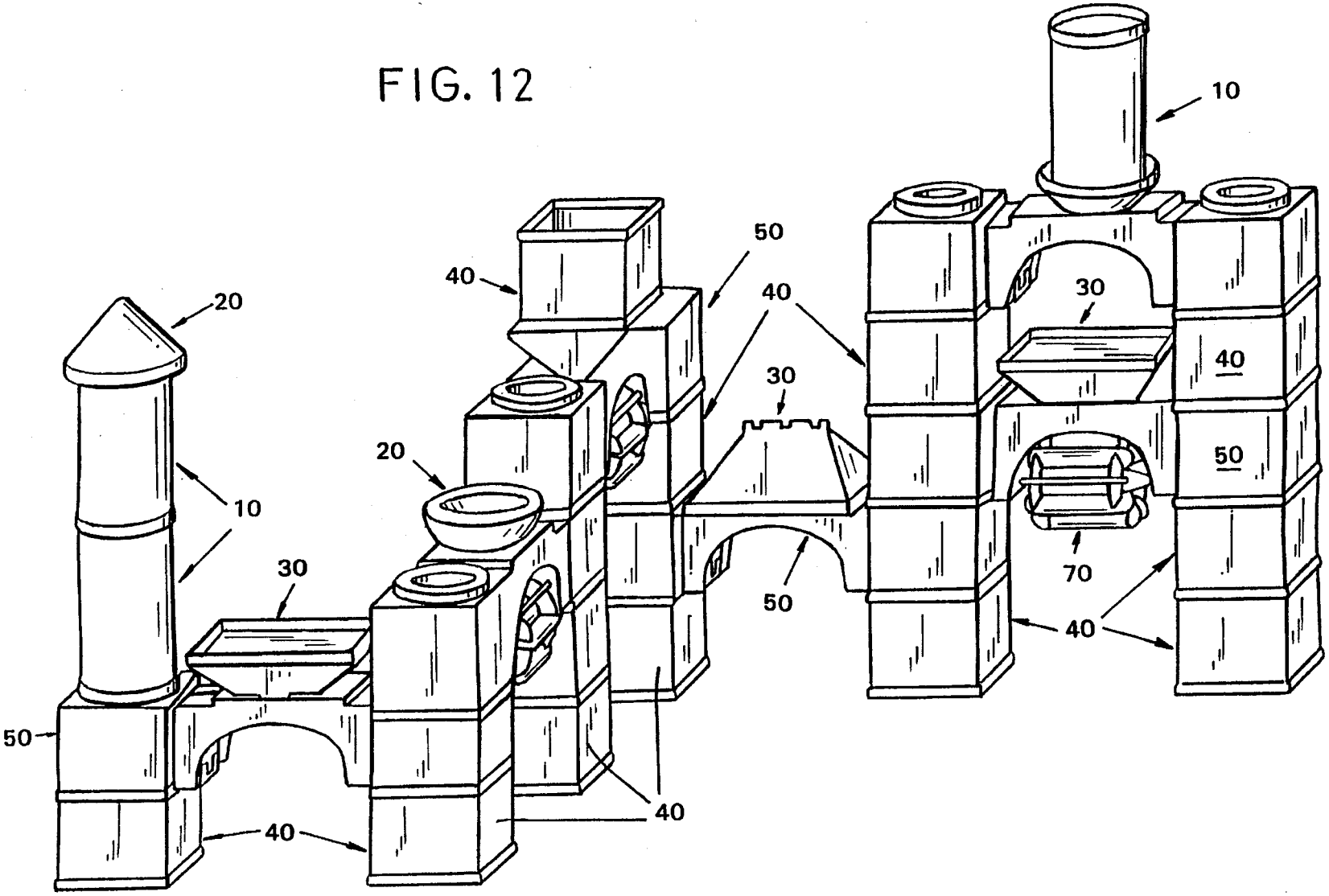
FIG. 12 shows another example of a structure formed by assembling pieces of the kit of the invention.
Figure 20:
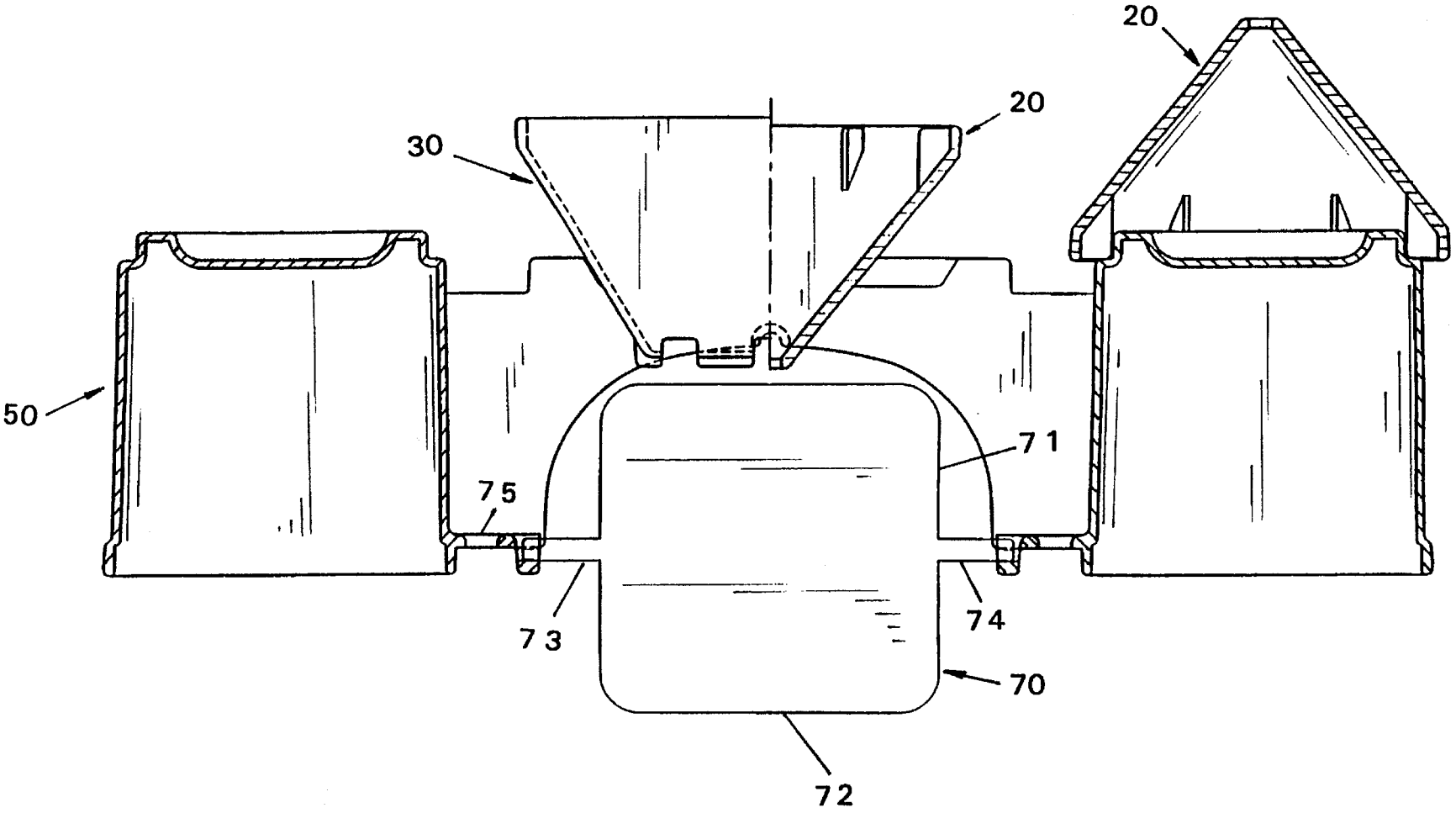
FIG. 20 shows an example of an assembly of a bridge piece, a cone piece and a prism piece.

FIG. 11 shows an example of one structure 60 that may be formed by assembling the pieces of the kit of the invention. A pair of cube pieces 40 are provided at the bottom of the structure 60. A first bridge piece 50 is assembled on top of the two cube pieces 40. The annular projection 44 at the top of each of the cube pieces 40 fits into the corresponding peripheral collar 56 provided in the bottom of the cube-like pillars of the first bridge piece 50. A second bridge piece 50 is assembled on top of the first bridge piece 50 and the upper annular projections 54 of the end portions of the first bridge piece 50 fit into the peripheral collars 56 provided in the bottom of the cube-like end portions of the second bridge piece 50. An inverted cone piece 20 can be positioned on the middle portion 52 of the first bridge piece 50 (as shown in FIG. 12). An inverted prism piece 30 is placed on the middle portion 52 of the second bridge piece 50. A pair of cylinder pieces 10 are assembled on top of each of the end portions of the second bridge piece 50. As is evident from FIG. 6, the annular collars 12 of the cylinder pieces 10 fit onto the corresponding annular projections 54 of the pillars of the second bridge piece 50. A pair of cone pieces 20 are assembled on top of the pair of cylinder pieces 10, respectively, with the collars 22 and the fins 24 of the cone pieces 20 fitting onto the annular projection 14 formed on top of the cylinder pieces 10. Since the cone 20 and prism 30 are inverted so that their closed tops have their holes in it downward, water or sand poured into the prism will pour or drip out of the holes in the top of the prism, out of the hole in the top of the cone and onto the piece 70 supported between the lower bridge pillars. That piece is a water wheel 70, comprised of a series of fins on a spinner, so that the wheel may rotate as water or sand pours onto it. The water wheel 70 used in FIG. 11 is seen in a cross-section in FIG. 20. The water wheel more broadly has the form of a spinning wheel which has a body including fins 71, 72 all around its periphery on which sand or water impinge to cause the wheel to spin on its axles 73, 74 received in axle bushings 75 beneath the end pillars of the bridge piece. In FIG. 20 the wheel 70 is shown beneath the holes at the top of either a prism 30 or a cone 20, which is supported on the bridge pieces. Numerous other pieces or shapes may be envisioned for inclusion in the toy kit.

FIG. 12 shows another example of a structure that can be formed by assembling the pieces of the invention. As is evident from FIG. 12, various interesting or complicated structures can be formed by using various combinations of the pieces of the invention. FIG. 12 also shows an additional water wheel piece 70. The water wheel piece 70 is useful for a water castle. A prism piece 30 placed apex down above the water wheel 70 could pour water or sand on the water wheel 70 to spin it.

FIG. 13 shows an assembly of cone, cylinder and cube building pieces of the invention. As shown in the enlarged views of FIGS. 14–17, the various pieces can be assembled by fitting corresponding nestable portions together. The possibilities for such assemblies were suggested when each of the individual pieces was discussed above. In this manner, any desired structure may be formed.

Figure 19:
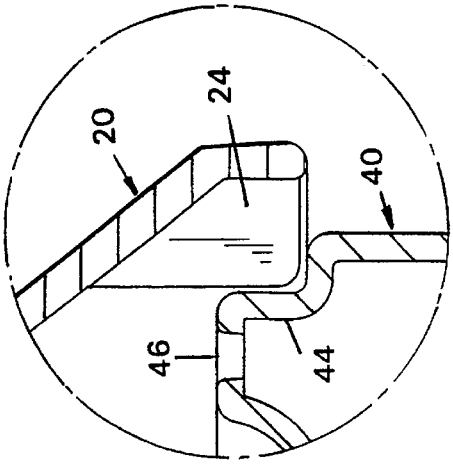
FIGS. 18 and 19 show, respectively, a cone piece assembled with a cube piece and an enlarged view of the connection between the pieces.
Figure 18:
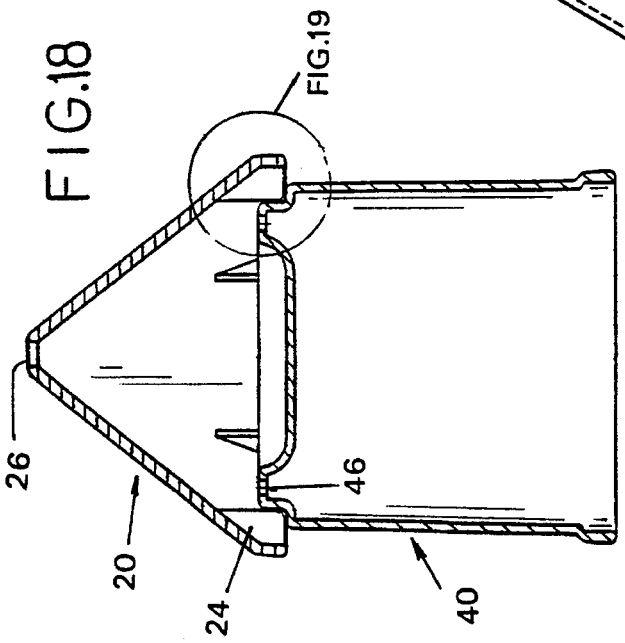
Figure 22:
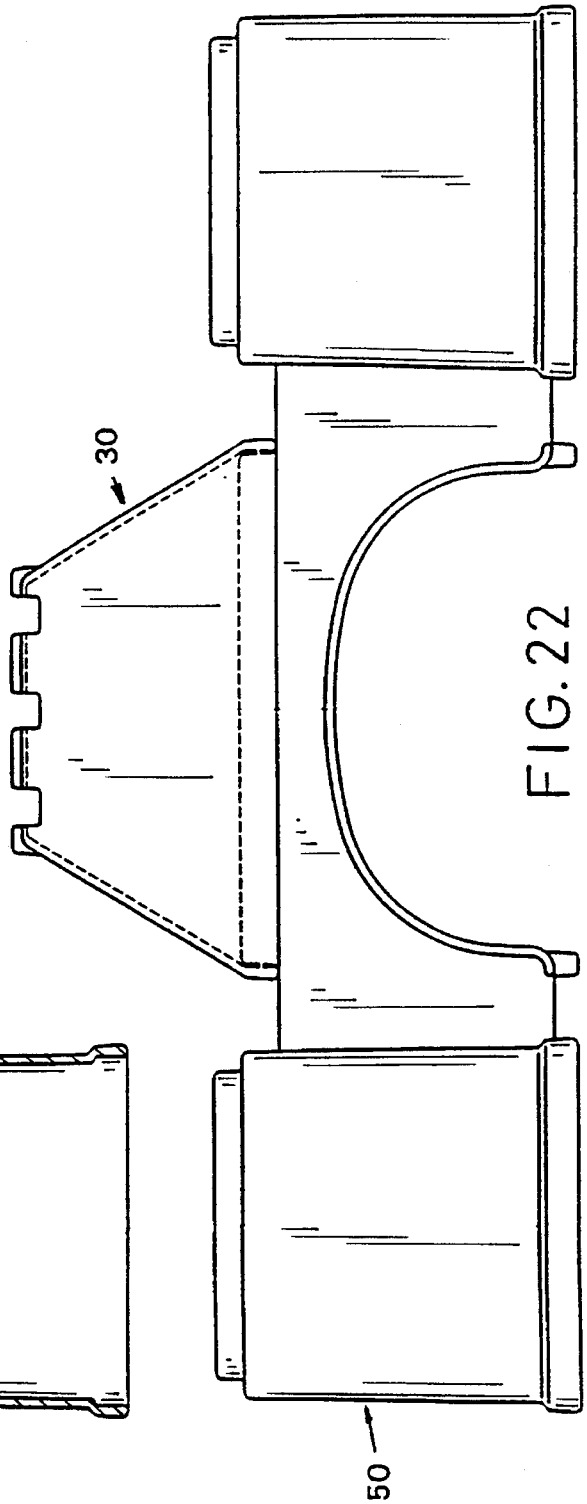
FIG. 22 shows yet another example of an assembly including a bridge piece.

FIG. 18 shows an assembly of cone and cube pieces. An enlarged view of the connection between the cone and cube pieces is shown in FIG. 19. FIGS. 20–22 show examples of various interesting combinations of the building pieces including the bridge piece. As is evident from FIG. 21, the prism piece 30 receives on a single pivot, allowing a tilted bridge piece 50 structure, as might be useful when a structure is erected on an incline.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A toy kit for forming a structure, comprising individual pieces including at least one each of a cylinder, cone, cube and prism; and at least one additional piece, the pieces being assemblable so as to form a structure, each of the individual pieces including a bottom and a peripheral collar around the bottom for connecting the piece with another one of the pieces, wherein the cone has a hollow, generally conical structure and including a top; the bottom of the cone is open;

the collar of the cone is an annular projection formed at the bottom of the cone;

the cone having an inner surface; a plurality of fins attached to and extending inward from the inner surface of the cone near the bottom for disposition on the outside of another piece for positioning the cone piece thereon; and an opening provided at the top of the cone.

2. The toy kit of claim 1, wherein at least some of the individual pieces also have a top and means at the top for receiving and engaging a collar on another of the pieces, so as to assemble the engaged pieces.

3. The toy kit of claim 1, wherein the additional piece includes means for connecting a first set of assembled pieces with a second set of assembled pieces.

4. The toy kit of claim 1, wherein the cylinder has a hollow, generally tubular structure including a top and the bottom, and the bottom is open;

the collar of the cylinder is an annular projection formed at the bottom of the cylinder;

the top of the cylinder is closed by an upper wall formed with a recessed portion at the top; holes defined in the upper wall of the cylinder; means at the top of the cylinder for receiving and engaging a collar on another of the pieces, so as to assemble the engaged pieces.

5. The toy kit of claim 1, wherein the prism has a hollow, generally prism shape and including a top; the bottom of the prism is open;

the collar of the prism is formed around the bottom of the prism; and a series of notches spaced along the top of the prism defining holes along the top of the prism.

6. The toy kit of claim 1, wherein the cube has a hollow, generally cubical shape including a top; the bottom of the cube is open; a respective collar provided at both the top and the bottom of the cube;

an upper wall at the top of the cube so as to form a recessed portion at the top, holes defined in the upper wall of the cube.

7. The toy kit of claim 1, wherein the additional piece is a bridging piece having end pillars and a connecting a central portion; the pillars each having a top and a bottom, projections provided at both the top and the bottom of the pillars for connection to other pieces; an upper wall provided on the top of each pillar, holes provided in the upper wall.

8. The toy kit of claim 7, further comprising an indentation formed in the underside of the central portion of the bridging piece shaped for receiving the top of the prism, or the like.

9. The toy kit of claim 7, comprising a further additional piece in the form of a spinning wheel including fins to be contacted by falling water or sand and spin axles supported in the bridge piece.

10. A toy kit for forming a structure, comprising individual pieces including at least one each of a cylinder cone, cube and prism; and at least one additional bridge piece, having end pillars and a connecting central portion; the pillars each having a top and a bottom, projections provided at both the top and the bottom of the pillars for connection to other pieces; and a piece in the form of a spinning wheel including fins to be contacted by falling water or sand and spin axles supported in the bridge piece, the pieces being assemblable so as to form a structure.

11. The toy kit of claim 10, wherein each of the individual pieces includes a bottom and a peripheral collar around the bottom for connecting the piece with another one of the pieces.

12. The toy kit of claim 10, wherein the bridge piece further includes means for supporting another of the kit pieces; at least some of the kit pieces supported on the support means of the bridge having a top with a hole therethrough for passage of water or sand; the support means being for supporting the piece with the hole in its top over the spinning wheel for delivering water or sand thereto.

13. A toy kit for forming a structure, comprising individual pieces including at least one each of a cylinder, cone, cube and prism; and at least one additional piece, the pieces being assemblable so as to form a structure, at least some of the individual pieces also having a top and means at the top for receiving and engaging a collar on another of the pieces, so as to assemble the engaged pieces;

the cylinder has a hollow, generally tubular structure including a top and a bottom, and the bottom is open;

an annular projection formed at the bottom of the cylinder;

the top of the cylinder is closed by an upper wall formed with a recessed portion at the top; holes defined in the upper wall of the cylinder; means at the top of the cylinder for receiving and engaging a collar on another of the pieces, so as to assemble the engaged pieces;

the cone has a hollow, generally conical structure and including a top and a bottom; the bottom of the cone is open;

an annular projection formed at the bottom of the cone;

the cone having an inner surface; a plurality of fins attached to and extending inward from the inner surface of the cone near the bottom for disposition on the outside of another piece for positioning the cone piece thereon; and an opening provided at the top of the cone;

the prism has a hollow, generally prism shape and including a top and a bottom; the bottom of the prism is open;

a collar around the bottom of the prism; and a series of notches spaced along the top of the prism defining holes along the top of the prism;

the cube has a hollow, generally cubical shape including a top and a bottom; the bottom of the cube is open; a respective collar provided at both the top and the bottom of the cube;

an upper wall at the top of the cube so as to form a recessed portion at the top.

14. The toy kit of claim 10, wherein the bridge piece is for connecting a first set of assembled pieces with a second set of assembled pieces.

* * * * *